US010699723B2

(12) United States Patent
Chau et al.

(10) Patent No.: US 10,699,723 B2
(45) Date of Patent: Jun. 30, 2020

(54) ENCODING AND DECODING OF DIGITAL AUDIO SIGNALS USING VARIABLE ALPHABET SIZE

(71) Applicant: DTS, Inc., Calabasas, CA (US)

(72) Inventors: Albert Chau, Vancouver (CA); Antonius Kalker, Mountain View, CA (US); Gadiel Seroussi, Cupertino, CA (US)

(73) Assignee: DTS, Inc., Calabasas, CA (US)

( * ) Notice: Subject to any disclaimer, the term of this patent is extended or adjusted under 35 U.S.C. 154(b) by 137 days.

(21) Appl. No.: 15/926,089

(22) Filed: Mar. 20, 2018

(65) Prior Publication Data

US 2018/0308497 A1 Oct. 25, 2018

Related U.S. Application Data

(60) Provisional application No. 62/489,867, filed on Apr. 25, 2017.

(51) Int. Cl.
*G10L 19/008* (2013.01)
*G10L 19/022* (2013.01)
*G10L 25/18* (2013.01)

(52) U.S. Cl.
CPC ..... *G10L 19/008* (2013.01); *G10L 19/022* (2013.01); *G10L 25/18* (2013.01)

(58) Field of Classification Search
CPC ..... G10L 19/008; G10L 19/022; G10L 25/18
See application file for complete search history.

(56) References Cited

U.S. PATENT DOCUMENTS

2002/0169601 A1* 11/2002 Nishio ..... G10L 19/032 704/205
2007/0016412 A1 1/2007 Mehrotra et al.
2009/0180531 A1* 7/2009 Wein ..... G10L 19/08 375/240

(Continued)

FOREIGN PATENT DOCUMENTS

WO 2018200426 11/2018

OTHER PUBLICATIONS

"International Application Serial No. PCT US2018 028987, International Search Report dated Jul. 2, 2018", 2 pgs.

(Continued)

*Primary Examiner* — Sonia L Gay
(74) *Attorney, Agent, or Firm* — Schwegman Lundberg & Woessner, P.A.

(57) ABSTRACT

An audio encoder can parse a digital audio signal into a plurality of frames, each frame including a specified number of audio samples, perform a transform of the audio samples of each frame to produce a plurality of frequency-domain coefficients for each frame, partition the plurality of frequency-domain coefficients for each frame into a plurality of bands for each frame, each band having a reshaping parameter that represents a time resolution and a frequency resolution, and encode the digital audio signal to a bit stream that includes the reshaping parameters. For a first band, the reshaping parameter can be encoded using a first alphabet size. For a second band, the reshaping parameter can be encoded using a second alphabet size different from the first alphabet size. Using different alphabet sizes can allow for more compact compression in the bit stream.

20 Claims, 9 Drawing Sheets

(56) References Cited

U.S. PATENT DOCUMENTS

| | | | | |
|---|---|---|---|---|
| 2009/0240491 | A1 | 9/2009 | Reznik | |
| 2012/0069898 | A1* | 3/2012 | Valin | G10L 19/0204 375/240.03 |
| 2012/0232913 | A1 | 9/2012 | Terriberry et al. | |
| 2015/0279383 | A1* | 10/2015 | Crockett | G10L 15/04 704/500 |

OTHER PUBLICATIONS

"International Application Serial No. PCT US2018 028987, Written Opinion dated Jul. 2, 2018", 9 pgs.
"International Application Serial No. PCT/US2018/028987, International Preliminary Report on Patentability dated Nov. 7, 2019", 11 pgs.

* cited by examiner

```
uint MapTfSymbol(int s, bool is_narrow, uint d, bool is_long)
{
      const uint map_short_wide[]   = { 4, 3, 2, 0, 1 };
      const uint map_short_narrow[] = { 3, 2, 1, 0 };
      if ( d==0 ){
            if ( is_long )    // long block
                  s_out = s;  // leave symbol as-is
            } else {          // short block
                  int index = s + 3;
                  if ( is_narrow ) { // index is in {0, 1, 2, 3 }
                        s_out = map_short_narrow[index]
                  } else { // index is in { 0, 1, 2, 3, 4 }
                        s_out = map_short_wide[index]
                  }
            }
      } else {
            // d = 1 : first-difference mode
            // same processing for short and long transform,
            // narrow and wide distinguished by alphabet size
            uint alpha = is_narrow ? 4 : 5;

            // map the difference, mod alpha, to a symbol roughly in -
      alpha/2 .. alpha/2
            s1 = IntegerMapRicePos::MapPredErr(s, alpha);

            // now apply the positive preference Rice map, resulting in
            // a nonnegative integer in [0, alpha)
            s_out = IntegerMapRicePos::map(s1);
      }
      return s_out;
}
```

FIG. 8

```
const uint map_dk_pair[4] = { 2, 3, 0, 1 };
uint dk = 2*d + k;
uint dk_symb = map_dk_pair[dk];
```

FIG. 9

```
uint head = HeadLength(seq); // compute the head length
if (head == 0) {        // sequence is all zero
      write_bit(0);     // write a zero bit
      return;           // we're done
}

// if d=1, take the first difference and recompute head length;
// we assume that if the input was the all-zero sequence,
// d=0 would have been chosen.
if ( d == 1 ) {
      FirstDiff(seq);         // first difference in-place
      head = HeadLength(seq); // recompute head length
}

// encode the mapped (d,k) pair with a Golomb code
// of parameter 0 and alphabet size 4
GolombCodeFinite::Encode(0, 4, dk_symb);

// encode head-1 (we know head is positive) with
// a quasi-uniform code over an alphabet of size num_bands
QuasiUnifirmCode::Encode(num_bands, head-1);

// now encode the head symbols
for ( uint i=0; i<head; i++) {
      // map the symbol as described above
      s_out = MatTFSymbol(seq[i], is_narrow, d, is_long);
      if ( k == 0 ) {
            // encode with a Golomb code of parameter 0 and alphabet size
      alpha
            GolombCodeFinite::Encode(0, alpha, s_out);
      }
      else {
            // encode with a QuasiUniformCode over an alphabet of size
      alpha
            QuasiUniformCode:: Encode (alpha, s_out);
      }
}
```

FIG. 10

```
seq = zeros(num_bands); // start with all-zero sequence
uint bit = read_bit();
if ( !bit ) {
      // sequence is all-zeros
      return seq; // we're done
}

// read and decode the (d,k) pair
// decode a Golomb code of parameter 0 and alphabet size 4
uint dk_symb = GolombCodeFinite::Decode(0, 4);
const uint inv_map_dk_pair[4] = { 2, 3, 0, 1 };
uint dk = inv_map_dk_pair[dk_symb];
uint d = dk / 2;
uint k = dk % 2;

// decode head length (quasi-uniform code of alphabet size num_bands);
// recall that what was encoded was head-1
head = 1 + QuasiUniformCode::Decode(num_bands);

// decode the head symbols
for ( uint i=0; i < head; i++) {
      uint alpha = is_narrow ? 4 : 5;
      uint s;
      if ( k == 0 ) {
            // decode Golomb code of parameter 0 and alphabet size alpha
            s = GolombCodeFinite::Decode(0, alpha);
      }
      else {
            // decode quasi-uniform code of alphabet size alpha
            s = QuasiUniformCode(alpha);
      {
      // unmap the symbol (reverse the encoder's mapping, putting
      // the output symbol in a range appropriate to the
      // long vs. short, narrow vs. wide combination}
      int s_out = UnmapTFSymbol(s, is_narrow, ct, is_long);
      seq[i] = s_out; // insert in sequence
}

if ( d == 1 ) {
      // revert first differencing, in place
      InvFirstDiff(seq);
}

return seq;
```

FIG. 11

ENCODING AND DECODING OF DIGITAL AUDIO SIGNALS USING VARIABLE ALPHABET SIZE

CROSS-REFERENCE TO RELATED APPLICATION

This application claims the benefit of U.S. Provisional Application No. 62/489,867, filed Apr. 25, 2017, which is incorporated herein by reference in its entirety.

FIELD OF THE DISCLOSURE

The present disclosure relates to encoding or decoding an audio signal.

BACKGROUND OF THE DISCLOSURE

An audio codec can encode a time-domain audio signal into a digital file or digital stream, and decode a digital file or digital stream into a time-domain audio signal. There is ongoing effort to improve audio codecs, such as to reduce the size of an encoded file or stream.

SUMMARY

An example of an encoding system can include: a processor; and a memory device storing instructions executable by the processor, the instructions being executable by the processor to perform a method for encoding an audio signal, the method comprising: receiving a digital audio signal; parsing the digital audio signal into a plurality of frames, each frame including a specified number of audio samples; performing a transform of the audio samples of each frame to produce a plurality of frequency-domain coefficients for each frame; partitioning the plurality of frequency-domain coefficients for each frame into a plurality of bands for each frame, each band having reshaping parameter that represents a time resolution and a frequency resolution, encoding the digital audio signal to an bit stream that includes the reshaping parameter, wherein: for a first band, the reshaping parameter is encoded using a first alphabet size; and for a second band different from the first band, the reshaping parameter is encoded using a second alphabet size different from the first alphabet size; and outputting the bit stream.

An example of a decoding system can include: a processor; and a memory device storing instructions executable by the processor, the instructions being executable by the processor to perform a method for decoding an encoded audio signal, the method comprising: receiving a bit stream, the bit stream including a plurality of frames, each frame partitioned into a plurality of bands; for each band of each frame, extracting a reshaping parameter from the bit stream, the reshaping parameter representing a time resolution and a frequency resolution for the band, wherein: for a first band, the reshaping parameter is embedded in the bit stream using a first alphabet size; and for a second band different from the first band, the reshaping parameter is embedded in the bit stream using a second alphabet size different from the first alphabet size; and decoding the bit stream using the reshaping parameters to generate a decoded digital audio signal.

Another example of an encoding system can include: a receiver circuit to receive a digital audio signal; a framer circuit to parse the digital audio signal into a plurality of frames, each frame including a specified number of audio samples; a transformer circuit to perform a transform of the audio samples of each frame to produce a plurality of frequency-domain coefficients for each frame; a frequency band partitioner circuit to partition the plurality of frequency-domain coefficients for each frame into a plurality of bands for each frame, each band having a reshaping parameter that represents a time resolution and a frequency resolution, an encoder circuit to encode the digital audio signal to a bit stream that includes each band's reshaping parameter, wherein: for a first band, the reshaping parameter is encoded using a first alphabet size; and for a second band different from the first band, the reshaping parameter is encoded using a second alphabet size different from the first alphabet size; and an output circuit to output the bit stream.

BRIEF DESCRIPTION OF THE DRAWINGS

FIGS. 8-11 show examples of pseudo-code for encoding and decoding audio signals, in accordance with some examples.

Corresponding reference characters indicate corresponding parts throughout the several views. Elements in the drawings are not necessarily drawn to scale. The configurations shown in the drawings are merely examples, and should not be construed as limiting the scope of the invention in any manner.

DETAILED DESCRIPTION

In an audio encoding and/or decoding system, such as a codec, the reshaping parameter in different bands can be encoded using alphabets having different sizes. Using different alphabet sizes can allow for more compact compression in the bit stream (e.g., the encoded digital audio signal), as explained below in more detail.

Figure 1:
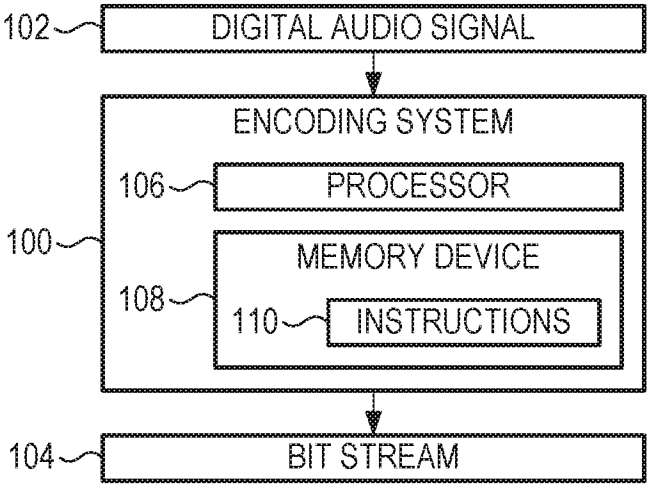
FIG. 1 shows a block diagram of an example of an encoding system, in accordance with some examples.

FIG. 1 shows a block diagram of an example of an encoding system 100, in accordance with some examples. The configuration of FIG. 1 is but one example of an encoding system; other suitable configurations can also be used.

The encoding system 100 can receive a digital audio signal 102 as input, and can output a bit stream 104. The input and output signals 102, 104 can each include one or more discrete files saved locally or on an accessible server, and/or one or more audio streams generated locally or on an accessible server.

The encoding system 100 can include a processor 106. The encoding system 100 can further include a memory device 108 storing instructions 110 executable by the processor 106. The instructions 110 can be executed by the processor 106 to perform a method for encoding an audio signal. Examples of such a method for encoding an audio signal are explained below in detail.

In the configuration of FIG. 1, the encoding is executed in software, typically by a processor that can also perform additional tasks in a computing device. As an alternative, the encoding can also be performed in hardware, such as by a dedicated chip or dedicated processor that is hard-wired to perform the encoding. An example of such a hardware-based encoder is shown in FIG. 2.

Figure 2:
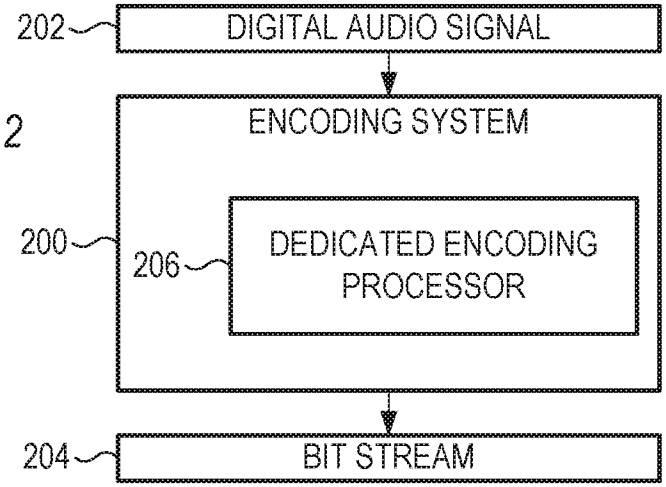
FIG. 2 shows a block diagram of another example of an encoding system, in accordance with some examples.

FIG. 2 shows a block diagram of another example of an encoding system 200, in accordance with some examples. The configuration of FIG. 2 is but one example of an encoding system; other suitable configurations can also be used.

The encoding system 200 can receive a digital audio signal 202 as input, and can output a bit stream 204. The encoding system 200 can include a dedicated encoding processor 206, which can include a chip that is hard-wired to perform a particular encoding method. Examples of such a method for encoding an audio signal are explained below in detail.

Figure 3:
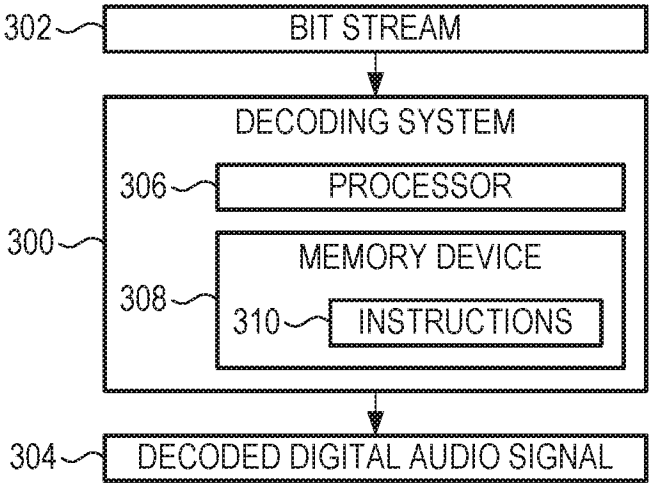
FIG. 3 shows a block diagram of an example of a decoding system, in accordance with some examples.
Figure 4:
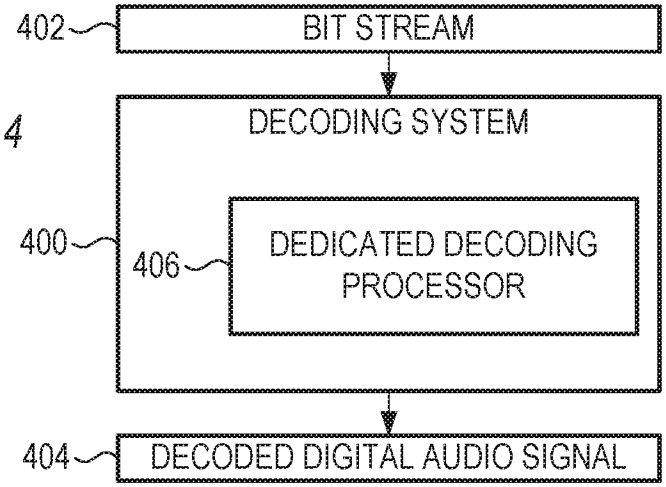
FIG. 4 shows a block diagram of another example of a decoding system, in accordance with some examples.

The examples of FIGS. 1 and 2 show encoding systems that can operate in software and in hardware, respectively. FIGS. 3 and 4 below show comparable decode systems that can operate in software and in hardware, respectively.

FIG. 3 shows a block diagram of an example of a decoding system, in accordance with some examples. The configuration of FIG. 3 is but one example of a decoding system; other suitable configurations can also be used.

The decoding system 300 can receive a bit stream 302 as input, and can output a decoded digital audio signal 304. The input and output signals 302, 304 can each include one or more discrete files saved locally or on an accessible server, and/or one or more audio streams generated locally or on an accessible server.

The decoding system 300 can include a processor 306. The decoding system 300 can further include a memory device 308 storing instructions 310 executable by the processor 306. The instructions 310 can be executed by the processor 306 to perform a method for decoding an audio signal. Examples of such a method for decoding an audio signal are explained below in detail.

In the configuration of FIG. 3, the decoding is executed in software, typically by a processor that can also perform additional tasks in a computing device. As an alternative, the decoding can also be performed in hardware, such as by a dedicated chip or dedicated processor that is hard-wired to perform the encoding. An example of such a hardware-based decoder is shown in FIG. 4.

FIG. 4 shows a block diagram of another example of a decoding system 400, in accordance with some examples. The configuration of FIG. 4 is but one example of a decoding system; other suitable configurations can also be used.

The decoding system 400 can receive a bit stream 402 as input, and can output a decoded digital audio signal 404. The decoding system 400 can include a dedicated decoding processor 406, which can include a chip that is hard-wired to perform a particular decoding method. Examples of such a method for decoding an audio signal are explained below in detail.

Figure 5:
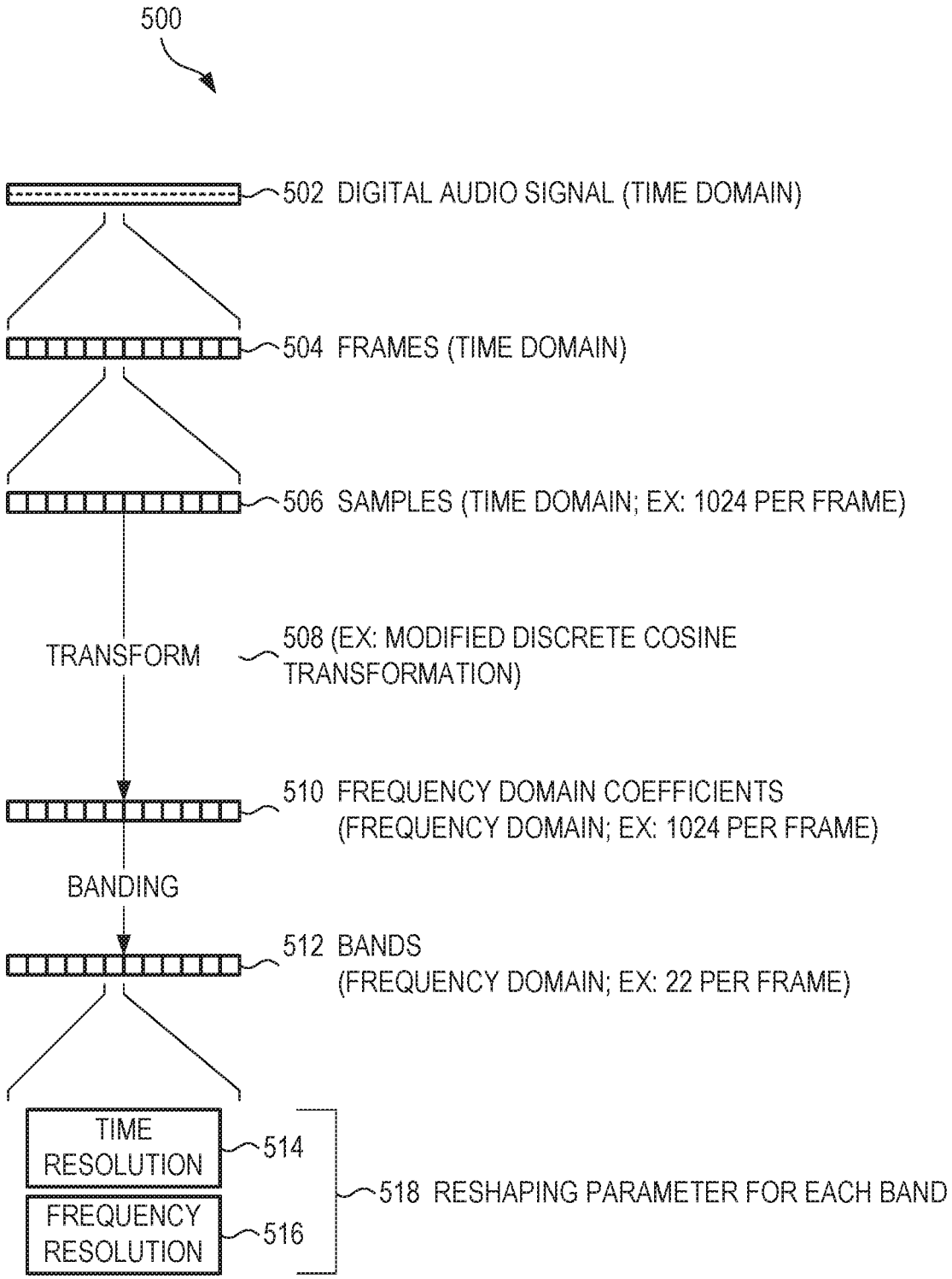
FIG. 5 shows several of the quantities involved with encoding a digital audio signal, in accordance with some examples.

FIG. 5 shows several of the quantities involved with encoding a digital audio signal, in accordance with some examples. Decoding a bit stream generally involves the same quantities as encoding the bit stream, but with mathematical operations performed in reverse. The quantities shown in FIG. 5 are but examples of such quantities; other suitable quantities can also be used. Each of the quantities shown in FIG. 5 can be used with any of the encoders or decoders shown in FIGS. 1-4.

The encoder can receive a digital audio signal 502. The digital audio signal 502 is in the time domain, and can include a sequence of integers or floating point numbers that represent an evolving amplitude of an audio signal over time. The digital audio signal 502 can be in the form of a stream (e.g., no specified beginning and/or end), such as a live feed from a studio. Alternatively, the digital audio signal 502 can be a discrete file (e.g., having a beginning and an end, and a specified duration), such as an audio file on a server, an uncompressed audio file ripped from a compact disc, or a mixdown file of a song in an uncompressed format.

The encoder can parse the digital audio signal 502 into a plurality of frames 504, where each frame 504 includes a specified number of audio samples 506. For example, a frame 504 can include 1024 samples 506, or another suitable value. In general, grouping the digital audio signal 502 into frames 504 allows an encoder to apply its processing efficiently to a well-defined number of samples 506. In some examples, such processing can vary frame-to-frame, so that each frame can be processed independently of the other frames.

The encoder can perform a transform 508 of the audio samples 506 of each frame 504. In some examples, the transform can be a modified discrete cosine transformation. Other suitable transforms can be used, such as Fourier, Laplace, and others. The transform 508 converts time-domain quantities, such as the samples 506 in a frame 504, into frequency-domain quantities, such as the frequency-domain coefficients 510 for the frame 504. The transform 508 can produce a plurality of frequency-domain coefficients 510 for each frame 504. In some examples, the number of frequency domain coefficients 510 produced by a transform 508 can equal the number of samples 506 in a frame, such as 1024. The frequency-domain coefficients 510 describe how much signal of a particular frequency is present in the frame.

In some examples, a time-domain frame can be subdivided into sub-blocks of contiguous samples, and a transform can be applied to each sub-block. For example, a frame of 1024 samples can be partitioned into eight sub-blocks of 128 samples each, and each such sub-block may be transformed into a block of 128 frequency coefficients. For examples in which the frame is partitioned into sub-blocks, the transform can be referred to as a short transform. For examples in which the frame is not partitioned into sub-blocks, the transform can be referred to as a long transform.

The encoder can partition the plurality of frequency-domain coefficients 510 for each frame 504 into a plurality of bands 512 for each frame 504. In some examples, there can be twenty-two bands 512 per frame, although other values can also be used. Each band 512 can represent a range of frequencies 510 in the frame 504, so that the concatenation of all the frequency ranges includes all the frequencies represented in the frame 504. For examples that use a short transform, each resulting block of frequency coefficients can be partitioned into the same number of bands, which can be in a one-to-one correspondence to the bands used for a long transform. For examples that use a short transform, the number of coefficients of a given band in a block is proportionally smaller as compared to the number of coefficients of that given band in the long transform case. For example, a frame can be partitioned into eight sub-blocks, a band in a short transform block has one-eighth of the number of coefficients in the corresponding band in a long transform. A band in the long transform may have thirty-two coefficients; in the short transform, the same band can have four coefficients in each of the eight frequency blocks. A band in the short transform can be associated with an eight-by-four matrix, having a resolution of eight in the time domain, and four in the frequency domain. A band in the long transform can be associated with a one-by-thirty-two matrix, with a resolution of one in the time domain, and thirty-two in the frequency domain. Thus, each band 512 can include a reshaping parameter 518 that represents a time resolution 514 and a frequency resolution 516. In some examples, the reshaping parameter 518 can represent a time resolution 514 and a frequency resolution 516 by providing a value of a change from default values of time resolution 514 and frequency resolution 516.

In general, it is a goal of a codec to ensure that the frequency-domain representation of a particular frame represents the time-domain representation of the frame as accurately as possible, using a limited amount of data that is governed by a particular data rate or bit rate of the encoded file. For example, data rates can include 1411 kbps (kilobits per second), 320 kbps, 256 kbps, 192 kbps, 160 kbps, 128 kbps, or other values. In general, the higher the data rate, the more accurate the representation of the frame.

In pursuing the goal of increasing accuracy using only a limited data rate, the codec can trade off between time resolution and a frequency resolution for each band. For example, the codec may double the time resolution of a particular band, while halving the frequency resolution of that band. Performing such operations (e.g., exchanging time resolution for frequency resolution, or vice versa) can be referred to as reshaping the time-frequency structure of a band. Although in the initial transform the time resolution of all the bands can be the same, in general, after reshaping, the time-frequency structure of one band in a frame can be independent of the time-frequency structure of other bands in the frame, so that each band can be reshaped independent of other bands.

In some examples, each band can have a size that equals a product of the time resolution 514 of the band and the frequency resolution 516 of the band. In some examples, the time resolution 514 of one band can equal eight audio samples, and the time resolution 514 of another band can equal one audio sample. Other suitable time resolutions 514 can also be used.

In some examples, the encoder can adjust a time resolution 514 and a frequency resolution 516 of each band of each frame in a complementary manner without varying the size of the band (e.g., without varying a product of the time resolution 514 and the frequency resolution 516). The encoder can quantify this adjustment with a reshaping parameter.

The reshaping parameter can be a selected integer. For example, if the reshaping parameter is 3, then the time resolution can be multiplied by the quantity $2^3$, and the frequency resolution can be multiplied by the quantity $2^{-3}$. Other suitable integers can be used, including positive integers (meaning that the time resolution 514 is increased and the frequency resolution 516 is decreased), negative integers (meaning that the time resolution is decreased and the frequency resolution is increased), and zero (meaning that time resolution 514 and frequency resolution 516 are unchanged, e.g., multiplied by the quantity $2^0$).

In some examples, the number of permissible reshaping parameter values can be constrained to a finite number of integers. As a specific example, the permissible reshaping parameter values can include 0, 1, 2, and 3, for a total of four integers. As another specific example, the permissible reshaping parameter values can include 0, 1, 3, and 4, for a total of five integers. As another specific example, the permissible reshaping parameter values can include 0, −1, −2, −3, and −4, for a total of five integers. As another specific example, the permissible reshaping parameter values can include 0, −1, −2, and −3, for a total of four integers. For these examples, the terminology to describe these specified ranges of integers is alphabet size. Specifically, the alphabet size for a range of integers is the number of permissible values in the range. For the four examples above, the alphabet size is four or five.

In some examples, a single frame can include one or more bands having reshaping parameters that can be encoded using a first alphabet size, and can further include one or more bands having reshaping parameters that can be encoded using a second alphabet size different from the first alphabet size. Using different alphabet sizes in this manner can allow for more compact compression in the bit stream.

The encoder can encode data representing the reshaping parameter for each band into the bit stream. Encoding the reshaping parameter into the bit stream can allow the decoder to reverse the time/frequency reshaping before applying the inverse transform. One straightforward approach can be forming a reshaping sequence for each frame, with each element of the reshaping sequence being a reshaping parameter for a band in the frame. For a frame with twenty-two bands, this would produce a reshaping sequence made up of twenty-two reshaping parameters. For each frame, the reshaping sequence can describe the reshaping parameter for each band. In some examples, the encoder can normalize each entry in each reshaping sequence to a range of possible values for the entry, each range of possible values corresponding to the specified range of reshaping parameters for the band.

As an improvement over this straightforward approach, the encoder can reduce the size of the data needed to fully describe these twenty-two integers. In this improved approach, the encoder can calculate the lengths of four sequences (e.g., the number of bits or integers in each of the four sequences), select the shortest sequence of the four sequences, and embed data representing the shortest sequence into the bit stream. The shortest sequence is the sequence that includes the fewest number of bits, or the sequence that describes the twenty-two integers most compactly. The four sequences are described below.

The encoder can form a first sequence for each frame, the first sequence describing the reshaping parameters for the frame as a sequence representing the reshaping parameter for each band, using a unary code. The encoder can form a second sequence for each frame, the second sequence describing the reshaping parameters for the frame as a sequence representing the reshaping parameter for each band, using a quasi-uniform code. The encoder can form a third sequence for each frame, the third sequence describing the reshaping parameters for the frame as a sequence representing the differences in reshaping parameters between adjacent bands, using a unary code. The encoder can form a fourth sequence for each frame, the fourth sequence describing the reshaping parameters for the frame as a sequence representing the differences in reshaping parameters between adjacent bands, using a quasi-uniform code.

The encoder can then select the shortest sequence of the first sequence, the second sequence, the third sequence, and the fourth sequence. The encoder can embed the selected shortest sequence into the bit stream, for each frame. The encoder can further embed data representing an indicator into the bit stream for each frame, the indicator indicating which of the four sequences is included in the bit stream.

The Appendix below provides rigorous mathematical definitions of the quantities discussed above.

Figure 6:
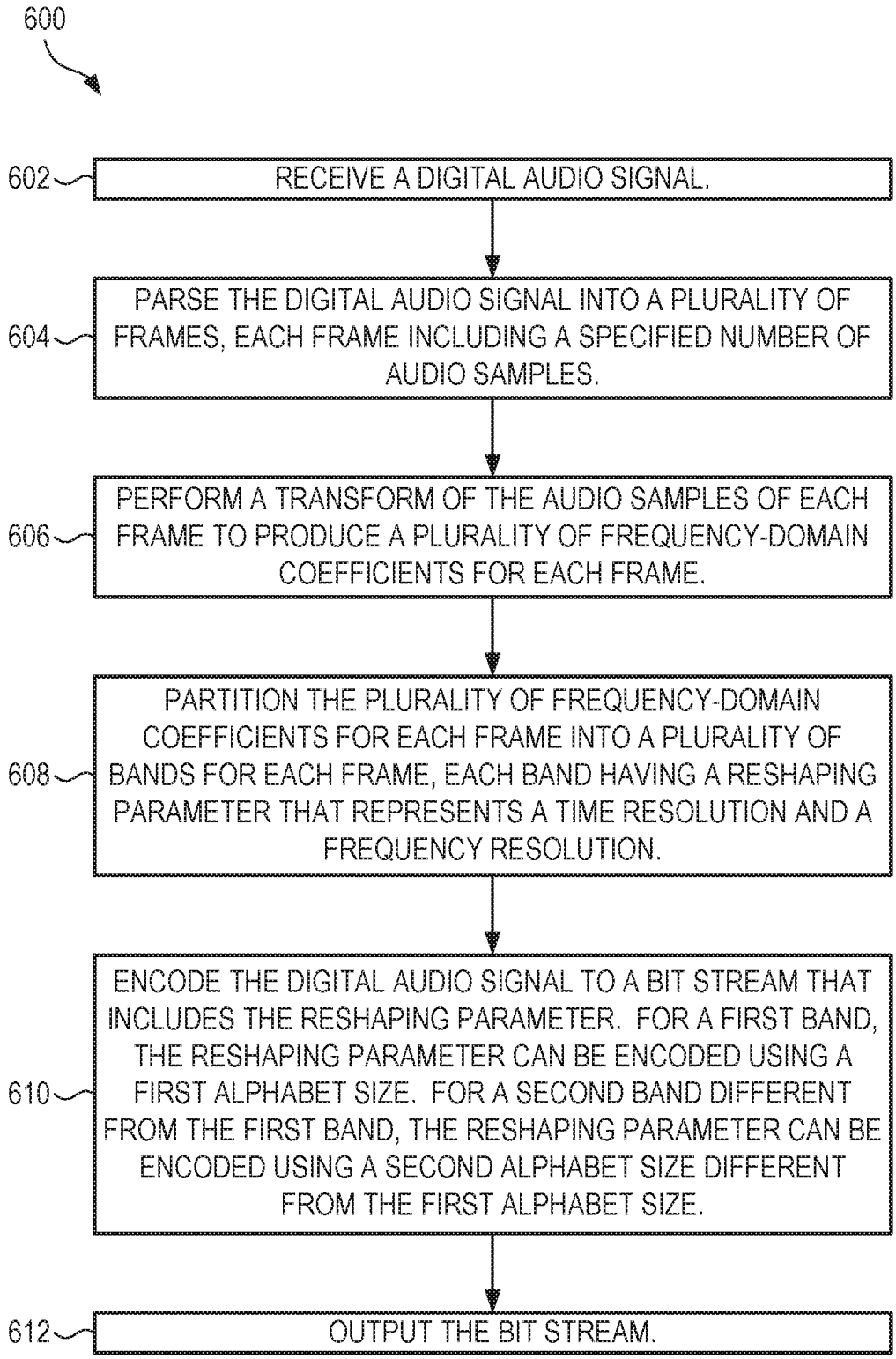
FIG. 6 shows a flowchart of an example of a method for encoding an audio signal, in accordance with some examples.

FIG. 6 shows a flowchart of an example of a method 600 for encoding an audio signal, in accordance with some examples. The method 600 can be executed by the encoding systems 100 or 200 of FIG. 1 or 2, or by any other suitable encoding system. The method 600 is but one method for encoding an audio signal; other suitable encoding methods can also be used.

At operation 602, the encoding system can receive a digital audio signal.

At operation 604, the encoding system can parse the digital audio signal into a plurality of frames, each frame including a specified number of audio samples.

At operation 606, the encoding system can perform a transform of the audio samples of each frame to produce a plurality of frequency-domain coefficients for each frame.

At operation 608, the encoding system can partition the plurality of frequency-domain coefficients for each frame into a plurality of bands for each frame, each band having a reshaping parameter that represents a time resolution and a frequency resolution.

At operation 610, the encoding system can encode the digital audio signal to a bit stream that includes the reshaping parameter. For a first band, the reshaping parameter can be encoded using a first alphabet size. For a second band different from the first band, the reshaping parameter can be encoded using a second alphabet size different from the first alphabet size.

At operation 612, the encoding system can output the bit stream.

Figure 7:
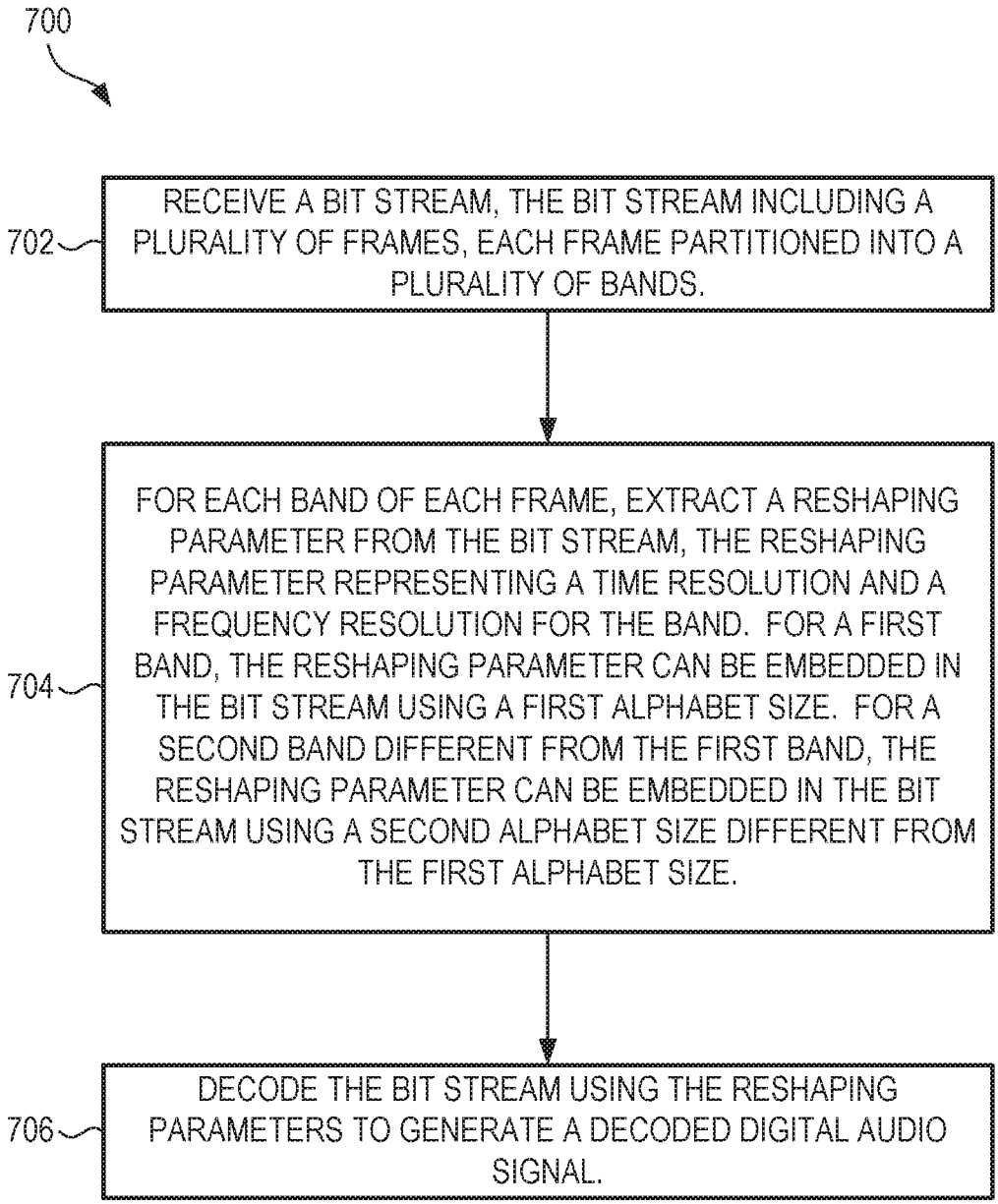
FIG. 7 shows a flowchart of an example of a method for decoding an encoded audio signal, in accordance with some examples.

FIG. 7 shows a flowchart of an example of a method 700 for decoding an encoded audio signal, in accordance with some examples. The method 700 can be executed by the decoding systems 300 or 400 of FIG. 3 or 4, or by any, other suitable encoding system. The method 700 is but one method for decoding an encoded audio signal; other suitable encoding methods can also be used.

At operation 702, the decoding system can receive a bit stream, the bit stream including a plurality of frames, each frame partitioned into a plurality of bands.

At operation 704, the decoding system can, for each band of each frame, extract a reshaping parameter from the bit stream, the reshaping parameter representing a time resolution and a frequency resolution for the band. For a first band, the reshaping parameter can be embedded in the bit stream using a first alphabet size. For a second band different from the first band, the reshaping parameter can be embedded in the bit stream using a second alphabet size different from the first alphabet size.

At operation 706, the decoding system can decode the bit stream using the reshaping parameter to generate a decoded digital audio signal.

Figure 12:
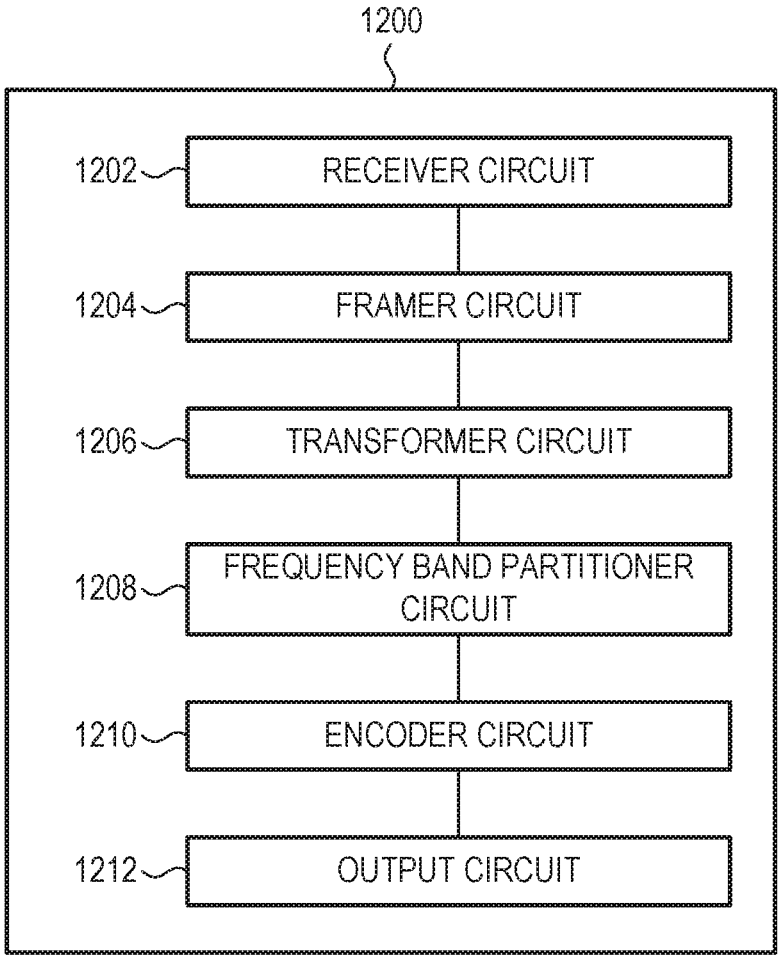
FIG. 12 shows a block diagram of an example of an encoding system, in accordance with some examples.

FIG. 12 shows a block diagram of an example of an encoding system 1200, in accordance with some examples.

A receiver circuit 1202 can receive a digital audio signal.

A framer circuit 1204 can parse the digital audio signal into a plurality of frames, each frame including a specified number of audio samples.

A transformer circuit 1206 can perform a transform of the audio samples of each frame to produce a plurality of frequency-domain coefficients for each frame.

A frequency band partitioner circuit 1208 can partition the plurality of frequency-domain coefficients for each frame into a plurality of bands for each frame, each band having a reshaping parameter that represents a time resolution and a frequency resolution.

An encoder circuit 1210 can encode the digital audio signal to a bit stream that includes each band's reshaping parameter. For a first band, the reshaping parameter can be encoded using a first alphabet size. For a second band different from the first band, the reshaping parameter can be encoded using a second alphabet size different from the first alphabet size.

An output circuit 1212 can output the bit stream.

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically found in devices having at least some minimum computational capability, including, but not limited to, personal computers, server computers, hand-held computing devices, laptop or mobile computers, communications devices such as cell phones and PDAs, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other microcontroller, or can be conventional central processing units (CPUs) having one or more processing cores, including specialized graphics processing unit (GPU)-based cores in a multi-core CPU.

The process actions of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CDROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or longlived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the encoding and decoding system and method described herein, or portions thereof, may be stored, received, transmitted, or read from any desired combination of computer or machine readable media or storage devices and communication media in the form of computer executable instructions or other data structures.

Embodiments of the system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

APPENDIX

Embodiments of the time-frequency change sequences codec and method described herein include techniques for efficiently encoding and decoding sequences describing time-frequency reshaping sequences. Embodiments of the codec and method address efficient encoding and decoding of sequences over heterogeneous alphabets.

Some codecs generate sequences that are much more complex than sequences typically used in existing codecs. This complexity arises from the fact that these sequences describe a richer set of possible time-frequency reshaping transformations. In some embodiments, a source of the complexity is that the elements of the sequence are drawn, potentially, from four different alphabets that are of different sizes or ranges (depending on the coordinate), and on the context of the audio frame being processed. Straightforward encoding of these sequences is costly and negates the advantages of the richer set.

Embodiments of the codec and method describe a highly efficient method that allows a uniform treatment of the heterogeneous alphabets, via various alphabet transformations, and optimizes coding parameters to obtain the shortest possible description. Some features of embodiments of the codec and method include the uniform treatment of heterogeneous alphabets, the definition of a plurality of coding modalities, and the choice of the modality that minimizes the length of the encoding. These features are part of what provide some of the advantages of embodiments of the codec and method including allowing the use of a richer set of time-frequency transforms.

Section 1: Definition of the Sequences

The modified discrete cosine transformation (MDCT) transform engine currently operates in two modes: long transform (used in most frames by default), and short transform (used in frames deemed to contain transients). If the number of MDCT coefficients in a given band is quantity N, then, in long transform mode, these coefficients are organized as one time slot containing N frequency slots (1×N). In short transform mode, the coefficients are organized as eight time slots, each containing N/8 frequency slots (8×N/8).

A time-frequency change sequence, or vector, is a sequence of integers, one per band, up to the number of effective bands in effect for the frame. Each integer indicates how the original time/frequency structure defined by the transform is modified for the corresponding band. If the original structure for the band is T×F (T time slots, F frequency slots), and the change value is c, then, through the application of appropriate local transforms, the structure is changed to $2^{c}T\times 2^{-c}F$. The range of admissible values of c is determined by integer constraints, which depend on whether the original mode is long or short and on the size of the band, and by limits on the number of supported time-frequency configurations.

A band is referred to as being narrow if its size is less than 16 MDCT bins. Otherwise, the band is referred to as being wide. All band sizes can be multiples of 8, and in the current implementation, at a 48 kHz sampling rate, bands numbered 0-7 can be narrow, and bands numbered 8-21 can be wide; at a 44 kHz sampling rate, bands numbered 0-5 can be narrow, and bands numbered 6-21 can be wide.

The following paragraphs show the sets of possible change values c for all the combinations of long vs. short transform and narrow vs. wide band.

For narrow and long: {0, 1, 2, 3}

For wide and long: {0, 1, 2, 3, 4}

For narrow and short: {−3, −2, −1, 0} wide and short: {−3, −2, −1, 0, 1}

Section 2: Sequence Encoding

Section 2.1: Basic Elements

The input to the encoding process is a sequence, or vector, $c=[c_0, c_1, \ldots, c_{M-1}]$, where quantity M is the number of effective bands, and values $c_i$ are in the appropriate ranges from the paragraphs above.

From the sequence c, one can derive a first difference sequence, or vector, $d=[d_0, d_1, \ldots, D_{M-1}]$, where $d_0=c_0$, and $d_i=c_i-c_{i-1}$, $0<i<M$. Define a parameter d of the encoding, signaling which sequence is encoded in the bitstream: sequence c when parameter d=0, or sequence d when parameter d=1. A discussion of how parameter d is determined follows below.

Given a sequence, or vector, $s=[s_0, x_1, \ldots, s_{M-1}]$, to encode, which may be sequence c or sequence d, we define:

$$\text{head}(s) = \begin{cases} 0, & s = 0, \\ 1 + \max\{i : s_i \neq 0\}, & \text{otherwise.} \end{cases}$$

Quantity head (s) is the length of the subsequence of sequence s extending from the first coordinate to the last nonzero coordinate. This subsequence is referred to as a head of s. Note that head(s)=0 if and only if sequences is an all-zero sequence.

The quantity head(s) is encoded as follows. If quantity head(s) equals zero, the encoder writes a zero bit and stops. For this case, the zero bit represents the whole reshaping vector, which is all zero, so that no further encoding is needed. If quantity head(s) is greater than zero, the encoder encodes quantity head(s)−1 using a quasi-uniform code over an alphabet of size M.

A quasi-uniform code over an alphabet of size alpha encodes integers in {0, 1, . . . , alpha−1} using either $L_1=\lfloor \log_2 \text{alpha} \rfloor$ bits or $L_2=\lfloor \log_2 \text{alpha} \rfloor$ bits, as follows:

Let $N=2^{L_2}$, $a_1=N-\text{alpha}$, $n_2=\text{alpha}-n_1$.

Symbols x, $0<=x<n_1$, are encoded by their binary representation in L1 bits.

Symbols x, $n_1<=x<n_1+n_2$, are encoded by the binary representation of $x+n_1$ in $L_2$ bits.

The symbols in the head of s are encoded symbol by symbol. Before encoding, each symbol is mapped using a mapping that depends on the choice of parameter d, long vs. short transform, and narrow vs, wide band. The mapping is defined in the pseudo-code function MapTFSymbol, shown in FIG. 8. It is assumed that input symbol sequence s, the variable d, and Boolean quantities is_long and is_narrow are given as parameters.

FIG. 8 shows a mapping that results, in all cases, in a nonnegative integer in the range [0, alpha), (i.e. {0, 1, . . . , alpha−1}), where quantity alpha is 4 for narrow bands, and 5 for wide bands. There are two choices of code for the mapped symbols, which are parametrized with a binary flag k:

k=0: A unary code over an alphabet of size alpha. The unary code encodes an integer i in {0, 1, . . . , alpha−2} by a sequence of i '0's followed by a '1', which marks the end of the encoding. The integer alpha−1 is encoded by a sequence of alpha−1 '0's, without a terminating '1'.

k=1: A quasi-uniform code over an alphabet of size alpha. How binary flag k is determined is discussed below.

Section 2.2: The Encoding

Assume the parameters d and k are known. The pair (d, k) is encoded as one symbol, obtained as shown in FIG. 9. The resulting symbol is encoded with a Golomb code; the permutation array map_dk_pair assigns indices in decreasing order of probability of occurrence of the pair (d, k), with (d=1, k=0) being the most likely, and receiving the shortest code word.

The encoding procedure is summarized in the pseudo-code of FIG. 10. The variable seq represents the input sequence e. The number of bands is available in a global variable num_bands.

Section 2.3: Parameter Optimization

To determine the parameters d and k, the encoder tries all four combinations of the binary values, and picks the one that gives the shortest code length. This is done using code length functions that do not require an actual encoding.

Section 3: Sequence Decoding

The decoder just reverses the steps of the encoder, except that it reads the parameters d and k from the bit stream and does not need to optimize them. The decoding procedure is summarized in the pseudo-code of FIG. 11, where quantity num_bands is the known number of bands.

What is claimed is:

1. An encoding system, comprising:

a processor; and a memory device storing instructions executable by the processor, the instructions being executable by the processor to perform a method for encoding an audio signal, the method comprising:

receiving a digital audio signal;

parsing the digital audio signal into a plurality of frames, each frame including a specified number of audio samples;

performing a transform of the audio samples of each frame to produce a plurality of frequency-domain coefficients for each frame;

partitioning the plurality of frequency-domain coefficients for each frame into a plurality of bands for each frame, each band having a reshaping parameter that represents a time resolution and a frequency resolution, encoding the digital audio signal to a bit stream that includes each band's reshaping parameter, wherein:

for a first band, the reshaping parameter is encoded using a first alphabet size; and for a second band different from the first band, the reshaping parameter is encoded using a second alphabet size different from the first alphabet size; and outputting the bit stream.

2. The encoding system of claim 1, further comprising:

adjusting a time resolution and a frequency resolution of each band of each frame, the first time resolution and the first frequency resolution being adjusted in a complementary manner by a magnitude described by the reshaping parameter, the reshaping parameter having a value that is an integer selected from one of a plurality of specified ranges of integers, wherein:

the first alphabet size equals a number of integers in a first specified range of integers of the plurality of specified ranges of integers; and the second alphabet size equals a number of integers in a second specified range of integers of the plurality of specified ranges of integers.

3. The encoding system of claim 2, wherein the first alphabet size is four, and the second alphabet size is five.

4. The encoding system of claim 1, wherein prior to the adjusting, the time resolution of the first band equals eight audio samples, and the time resolution of the second band equals one audio sample.

5. The encoding system of claim 2, wherein:

each band has a size that equals a product of the time resolution of the band and the frequency resolution of the band; and the time resolution of the band and the frequency resolution of the band are adjusted in a complementary manner without varying the size of the band.

6. The encoding system of claim 5, wherein the time resolution is adjusted by a factor of $2^c$, and the frequency resolution is varied by a factor of $2^{-c}$, where quantity c is the reshaping parameter.

7. The encoding system of claim 2, further comprising:

forming a reshaping sequence for each frame, the reshaping sequence describing the reshaping parameter for each band; and normalizing each entry in each reshaping sequence to a range of possible values for the entry, each range of possible values corresponding to the specified range of integers for the band.

8. The encoding system of claim 1, further comprising:

forming a first sequence for each frame, the first sequence describing the reshaping parameter for the frame as a sequence representing the reshaping parameter for each band, using a unary code;

forming a second sequence for each frame, the second sequence describing the reshaping parameter for the frame as a sequence representing the reshaping parameter for each band, using a quasi-uniform code;

forming a third sequence for each frame, the third sequence describing the reshaping parameter for the frame as a sequence representing the differences in reshaping parameters between adjacent bands, using a unary code;

forming a fourth sequence for each frame, the fourth sequence describing the reshaping parameter for the frame as a sequence representing the differences in reshaping parameters between adjacent bands, using a quasi-uniform code;

selecting the shortest sequence of the first sequence, the second sequence, the third sequence, and the fourth sequence, the shortest sequence being the sequence that includes the fewest number of elements;

embedding data representing the selected shortest sequence into the bit stream, for each frame; and embedding data representing an indicator into the bit stream for each frame, the indicator indicating which of the four sequences is included in the bit stream.

9. The encoding system of claim 1, wherein the transform is a modified discrete cosine transform.

10. The encoding system of claim 1, wherein each frame includes exactly 1024 samples.

11. The encoding system of claim 1, wherein a number of frequency-domain coefficients in each plurality of frequency-domain coefficients equals the specified number of audio samples in each frame.

12. The encoding system of claim 1, wherein the plurality of frequency-domain coefficients for each frame includes exactly 1024 frequency-domain coefficients.

13. The encoding system of claim 1, wherein the plurality of bands for each frame includes exactly 22 bands.

14. The encoding system of claim 1, wherein the encoding system is included in a codec.

15. A decoding system, comprising:

a processor; and a memory device storing instructions executable by the processor, the instructions being executable by the processor to perform a method for decoding an encoded audio signal, the method comprising:

receiving a bit stream, the bit stream including a plurality of frames, each frame partitioned into a plurality of bands;

for each band of each frame, extracting a reshaping parameter from the bit stream, the reshaping parameter representing a time resolution and a frequency resolution for the band, wherein:

for a first band, the reshaping parameter is embedded in the bit stream using a first alphabet size; and for a second band different from the first band, the reshaping parameter is embedded in the bit stream using a second alphabet size different from the first alphabet size; and decoding the bit stream using the reshaping parameters to generate a decoded digital audio signal.

16. The decoding system of claim 15, further comprising, for each band of each frame, extracting data indicating:

whether the reshaping parameter in the bit stream is represented as a unary code or a quasi-uniform code, and whether the reshaping parameter in the bit stream is represented as a sequence representing the reshaping parameter for each band or a sequence representing the differences in reshaping parameters between adjacent bands.

17. The decoding system of claim 15, wherein the decoding system in included in a codec.

18. An encoding system, comprising:

a receiver circuit to receive a digital audio signal;

a framer circuit to parse the digital audio signal into a plurality of frames, each frame including a specified number of audio samples;

a transformer circuit to perform a transfoiin of the audio samples of each frame to produce a plurality of frequency-domain coefficients for each frame;

a frequency band partitioner circuit to partition the plurality of frequency-domain coefficients for each frame into a plurality of bands for each frame, each band having a reshaping parameter that represents a time resolution and a frequency resolution, an encoder circuit to encode the digital audio signal to a bit stream that includes each band's reshaping parameter, wherein:

for a first band, the reshaping parameter is encoded using a first alphabet size; and for a second band different from the first band, the reshaping parameter is encoded using a second alphabet size different from the first alphabet size; and an output circuit to output the bit stream.

19. The encoding system of claim 18, further comprising:

a resolution adjustment circuit to adjust a time resolution and a frequency resolution of each band of each frame, the first time resolution and the first frequency resolution being adjusted in a complementary manner by a magnitude described by the reshaping parameter, the reshaping parameter having a value that is an integer selected from one of a plurality of specified ranges of integers, wherein:

the first alphabet size equals a number of integers in a first specified range of integers of the plurality of specified ranges of integers; and the second alphabet size equals a number of integers in a second specified range of integers of the plurality of specified ranges of integers.

20. The encoding system of claim 19, wherein the time resolution is adjusted by a factor of $2^c$, and the frequency resolution is varied by a factor of $2^{-c}$, where quantity c is the reshaping parameter.

* * * * *